US005871192A

United States Patent [19]

Horwitz

[11] Patent Number: 5,871,192

[45] Date of Patent: Feb. 16, 1999

[54] WALL-MOUNTED BRACKET FOR STORING AND DISPLAYING MODEL AIRPLANES

[76] Inventor: Jack B. Horwitz, 13314 Mission Tierra Way, Granada Hills, Calif. 91344

[21] Appl. No.: 929,517

[22] Filed: Sep. 15, 1997

[51] Int. Cl.[6] ..... E04G 3/00; A47F 1/10; A47F 5/00

[52] U.S. Cl. ..... 248/309.1; 248/274.1; 248/295.11

[58] Field of Search ..... 248/688, 693, 248/122.1, 124.1, 207, 226.11, 231.91, 274.1, 276.1, 287.1, 351, 354.1, 419, 309.1, 582, 597, 600

[56] References Cited

U.S. PATENT DOCUMENTS

| | | | |
|---|---|---|---|
| Re. 25,106 | 12/1961 | Freeman | 248/287.1 |
| 203,891 | 5/1878 | Conway | 248/287.1 |
| 1,363,692 | 12/1920 | Goldstein | 248/600 |
| 1,400,974 | 12/1921 | Parker | 248/600 |
| 1,755,093 | 4/1930 | Appel | 248/287.1 |
| 2,652,220 | 9/1953 | Nocht | 248/187 |
| 2,916,243 | 12/1959 | Johnston | 248/226 |
| 2,977,084 | 3/1961 | Brown et al. | 248/351 |
| 3,199,823 | 8/1965 | Stall | 248/265 |
| 3,915,308 | 10/1975 | Ratzloff et al. | 211/88 |
| 4,108,313 | 8/1978 | Bogar, Jr. | 211/64 |
| 5,060,393 | 10/1991 | Silverman et al. | 33/512 |
| 5,062,617 | 11/1991 | Campbell | 267/132 |
| 5,069,411 | 12/1991 | Murphy | 248/287.1 |
| 5,082,234 | 1/1992 | Smith | 248/669 |

FOREIGN PATENT DOCUMENTS

| | | | |
|---|---|---|---|
| 531992 | 8/1955 | Italy | 248/287.1 |

*Primary Examiner*—Leslie A. Braun
*Assistant Examiner*—Michael D. Nornberg
*Attorney, Agent, or Firm*—Robert Louis Finkel

[57] ABSTRACT

A device for storing and displaying a model airplane. A vertical member adapted for easy attachment to a wall has an outwardly extending tongue at its lower end for retaining and supporting the model on its nose. A pair of wing retaining brackets are rotatably and pivotably mounted to a horizontal cross member adjustably mounted to the upright member. The wing retaining brackets are free to orient themselves to conform with the sweep of the leading edges of the model's wings and with the wings' dihedral and serve to immobilize the model and maintain its fuselage upright. Means for positioning the wing retaining brackets allow the device to accommodate models of varying size and configuration, and can be adjusted to allow the weight of the model to be supported by the fuselage alone, or by both the wings and the fuselage. In an alternative embodiment, the wing retaining brackets are mounted resiliently to the cross member, thereby allowing the weight of the model to be distributed equally, or in any other desired ratio, between the wings and the fuselage.

10 Claims, 2 Drawing Sheets

11
14
12
13
23
21
33
25
32
25
16
18
17
15
14

FIG. 3
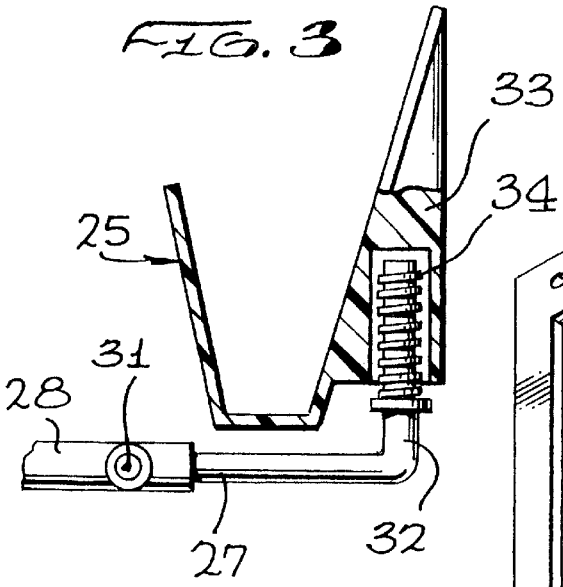
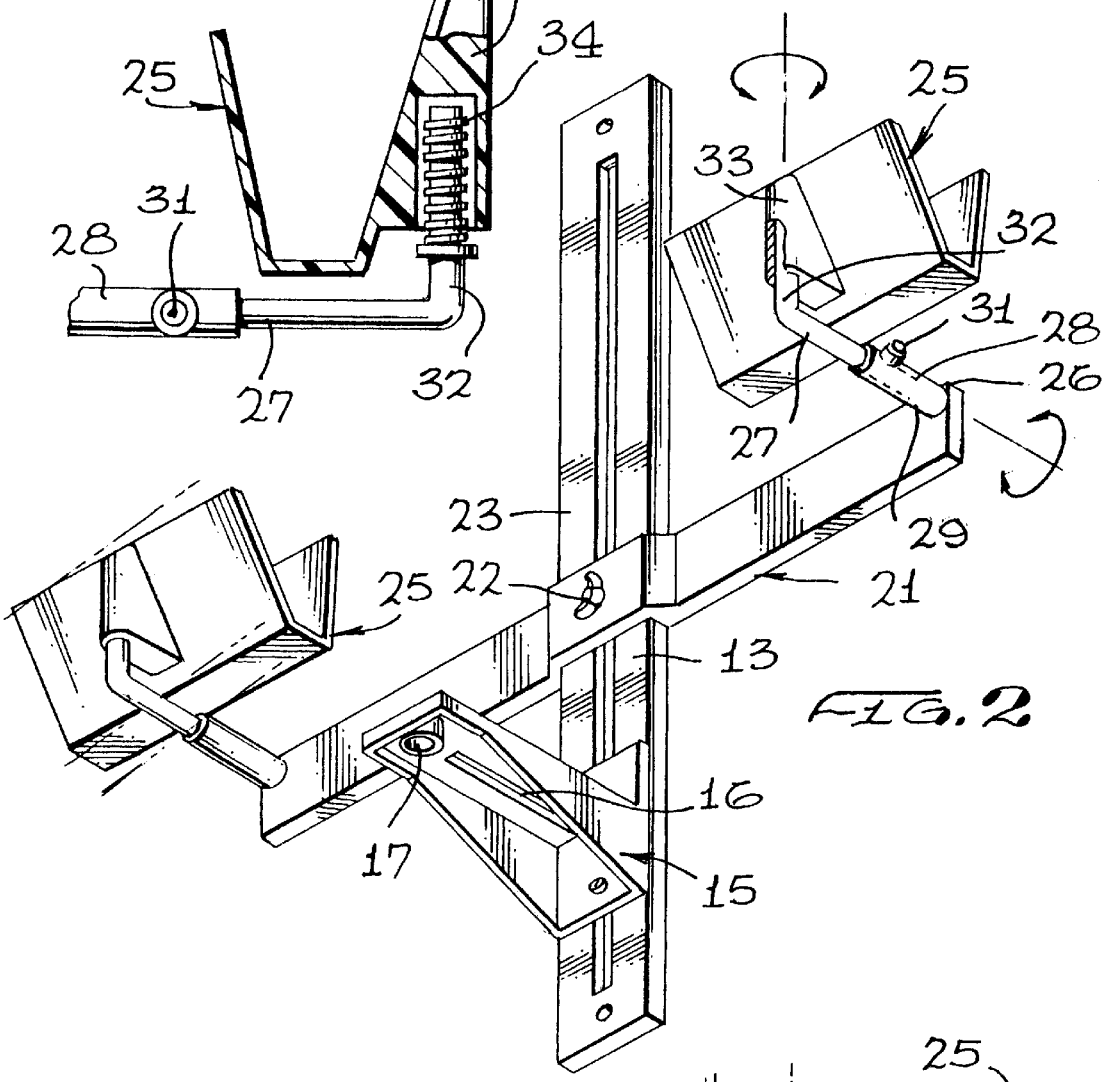
FIG. 2
FIG. 4
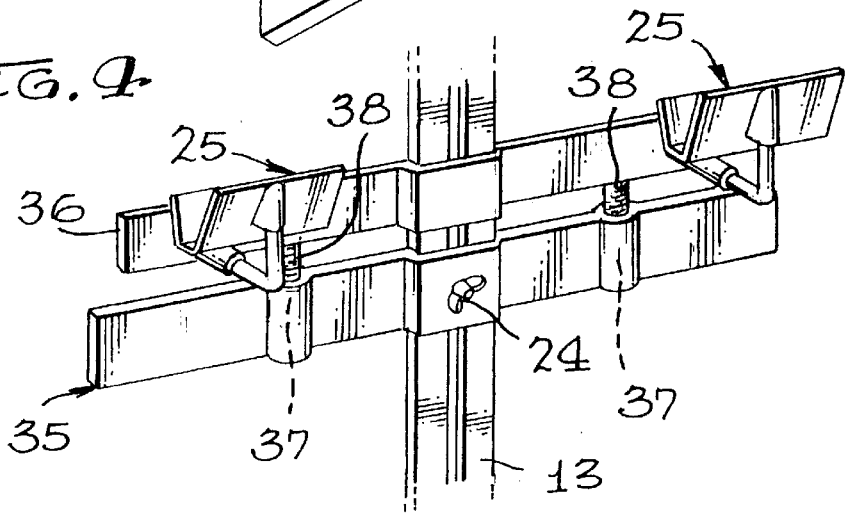

WALL-MOUNTED BRACKET FOR STORING AND DISPLAYING MODEL AIRPLANES

BACKGROUND OF THE INVENTION

1. Field of the Invention

This invention relates to devices for storing and displaying model airplanes, and more particularly to devices for mounting such airplanes to wails. Still more specifically, it concerns an adjustable wall-mounted bracket assembly for safely and conveniently supporting model airplanes of various sizes, weights, and configurations.

2. Prior Art

Storing small model airplanes, that is, those with a wingspan of up to, say, 2 feet and weighing 12 to 14 ounces poses few problems. Because of their small size and light weight, bench or shelf space can generally be found for them, and long periods of rest on their landing gear or supported horizontally on a table-top stand impose little if any structural stress. If space is at a premium, models of this class frequently are stored vertically by hanging them from wire or cord tethers secured to a wall and looped over or attached to their nose or empennage. For larger, heavier models, these storage and display methods are not satisfactory.

Shelf or tabletop space is generally not available for models with wingspans greater than 2 feet. Suspending larger, heavier models for long periods by means of hooks, rings, or straps attached to or around their nose or tail section is almost certain to result in the attachment hardware damaging the fuselage or tail component. In addition, since the typical single-point suspension device does not provide means for preventing the model from swinging and rotating, there is a likelihood that over time air currents and careless passers-by will cause surface or structural damage.

The availability of more powerful engines and the development of improved construction techniques and materials over the past 20 years have led to growing interest among enthusiasts in ever bigger, heavier models. "Jumbo" scale planes having wingspreads reaching over 7 feet and weights exceeding 30 pounds are not uncommon. Even when space for the horizontal display of such models is available, storing them for long periods on their landing gear creates flat spots on their tires and warped wings.

With the proliferation of models with spans in excess of three feet and weights exceeding 12 pounds, the need for a reliable storage system has become acute. The conventional response to this need is to hang it, nose upward or downward, on a pair of horizontally spaced wall-mounted supports, such as wire hooks bent to conform roughly to the contour of the trailing or leading edge of the model's wings. The model's weight is borne by the wings and rests on their trailing or leading edges at their points of contact with the hooks. Because of the great and ever growing disparity in the sizes and configurations of this category of models, most prior art mounting devices are either designed specifically for a particular model, with wing- or fuselage-supporting hardware attached to a wall-mounted backing, or offered as individual pieces of mounting hardware, such as common metal L-, or U-shaped brackets adapted to be attached to a wall at spaced intervals conforming to the configuration and size of the particular model. Both of these classes of devices suffer from a number of deficiencies. For one, neither of them is suitable for long-term storage. Most model aircraft wings are not designed to withstand substantial forces applied cordwise of the wing. Supporting a large, heavy model by its wings alone in either a nose-down or nose-up attitude over time can result in bending and warping of wing spars, ribs, and other structural components, twisting of fittings and fairings, and stressing of the aircraft skin.

Another deficiency concerns the limited utility of the prior art wall-support systems. The devices in which the brackets are joined or mounted to a backing are designed for use with a specific airplane model. Generally they either cannot be modified, or lend themselves only with difficulty to reconfiguration for use with another model. From a manufacturing standpoint, these devices create a requirement for diversity in product sizes and shapes which translates into unacceptably high production and inventory costs and stocking nightmares. Similarly for distributors and retailers, maintaining an adequate inventory to match even the most popular models poses a difficult and expensive challenge.

From the user's standpoint, another shortcoming resides in the fact that both types of devices are inconvenient and time-consuming to mount to the wall and equally troublesome to move or remove. The problem is exacerbated by the recurrent need to move or replace the device to accommodate a different model or models.

In most instances, the existing wall-mounting devices for larger models provide only vertical support for the model. With the leading edge of each wing resting on an open bracket, the model is free to move from side to side, and to a lesser but significant degree, to rotate in pitch and move from front to rear within the bracket. The potential for structural damage is magnified by the size and weight of the model. In most instances, to modify the existing wall-mounts to limit or prevent such movement would require most of them to be custom-fit to each model. Given the problems mentioned in connection with the production and marketing of the basic devices themselves, the diversity of such improvements would make the manufacture, stocking, distribution, and inventorying prohibitively difficult and expensive.

Viewed against this background, an object of the subject invention is to provide a novel, unitary wall-mounted bracket for storing and displaying model airplanes vertically and flush with a wall, which minimizes both the wall area and the room space required for any given model, reduces the model's exposure to damage from external sources, and virtually eliminates the possibility of wing warp or internal damage to the fuselage due to gravity.

Another object is to provide a novel construction for a wall-mounted support that is sturdy, lightweight, and durable, yet can be installed and removed with a minimum of effort.

Yet another object is to provide a storage device for model airplanes which can be readily adjusted to conform to models with a variety of sizes and shapes.

An additional object is to provide an adjustable model airplane support that incorporates means for restricting the movement of the mounted model and thereby minimizing the likelihood of its accidental damage.

Still another object is to provide a wall-mounted support device of the type described which can be fabricated from a minimum number of parts and modular components.

A further object is to provide a wall-mounted model airplane storage device construction satisfying all of the foregoing objects that is comparatively inexpensive to manufacture and requires a minimum of maintenance and repair.

Yet a further object is to provide a wall-mounted support construction of this type that permits the standardization and use of interchangeable parts and modular components.

A particular object of the invention is to provide a wall-mounted storage device for model airplanes, which incorporates in a single integrated structure adjustable means for supporting the weight of the model on the nose of the model.

Another particular object is to provide in such a device wing-retaining means for aiding in maintaining the model balanced upright on its nose.

A further particular object is to provide in an alternative embodiment of the invention wing-retaining means which in addition to aiding in maintaining the model balanced upright support a portion of the weight of the model as well.

Still another object is to provide a wall-mounted storage device for model airplanes, which incorporates in a single integrated structure adjustable means for supporting the weight of the model on both the wings and the nose of the model.

Yet a further object is to provide a wall-mounted support device of the type described in which the weight of the model is distributed fairly evenly between the wings and the nose of the model.

A still further object is to provide a wall-mounted airplane model support device of this type having means for adjusting the horizontal and vertical positioning, the orientation, and the angular alignment of the wing-supporting means with respect to the nose-supporting means.

Other objects will become apparent from the following summary of the invention and detailed description of its preferred embodiments.

SUMMARY OF THE INVENTION

The subject invention is a unitary assembly for mounting a model airplane vertically, nose downward, to a wall. The device is designed to support at least a portion of the model's weight on its nose, with wing-retaining brackets maintaining the fuselage upright. The wing-retaining brackets are adjustable to conform to the size and configuration of the model, or more accurately, to the location, shape, and orientation of the regions of its wings and fuselage best suited for supporting and immobilizing the model.

In a preferred embodiment of the invention, the device incorporates a vertical member adapted for easy mounting to a vertical wall, beam, or stud. A tongue extending outwardly of the lower end of the vertical member provides support for the nose of the aircraft, preferably the propeller spinner or exposed end of the drive shaft of the model's engine. retaining means in the form of a pair of horizontally spaced, elongated, upwardly-flared "V-", or "U"-shaped brackets, are rotatably and pivotably mounted to a horizontally disposed cross member which is slidably mounted to the upright member. The wing-retaining brackets are free to orient themselves to conform with sweep of the leading edges of the model's wings and with the wings' dihedral. Adjusting the position of the cross member on the vertical member configures the wing-retaining brackets to the wings of the model and effectively maintains the model vertical and immobile. If desired, the cross member may be positioned so as to allow the wing-retaining brackets to support at least a portion of the weight of the model.

Another embodiment of the invention provides means for adjusting the spacing between the upright member and the wing supporting brackets to accommodate models of varying size and configuration. Still another embodiment provides resilient means for mounting the wing supporting brackets to the cross member or to the vertical member, thereby allowing the weight of the model to be distributed equally or in any desired ratio between the wings and the fuselage.

For a fuller understanding of the invention and its function and advantages, reference is made to the following detailed description of the embodiments illustrated in the accompanying drawings, in which:

BRIEF DESCRIPTION OF THE DRAWINGS

FIG. 2 is an enlarged frontal perspective view of the embodiment of FIG. 1, with portions cut away to expose its internal construction;

FIG. 3 is a fragmentary side view of an alternative embodiment of the wing-retaining bracket assembly of the invention, with portions cut away to expose its internal construction; and FIG. 4 is a fragmentary frontal perspective view of another alternative embodiment of the wing-retaining bracket mounting assembly of the invention, with portions cut away to expose its internal construction.

Wherever practicable, the same numeral is used to identify identical or substantially similar features appearing in the several figures.

DETAILED DESCRIPTION OF THE PREFERRED EMBODIMENTS

Figure 1:
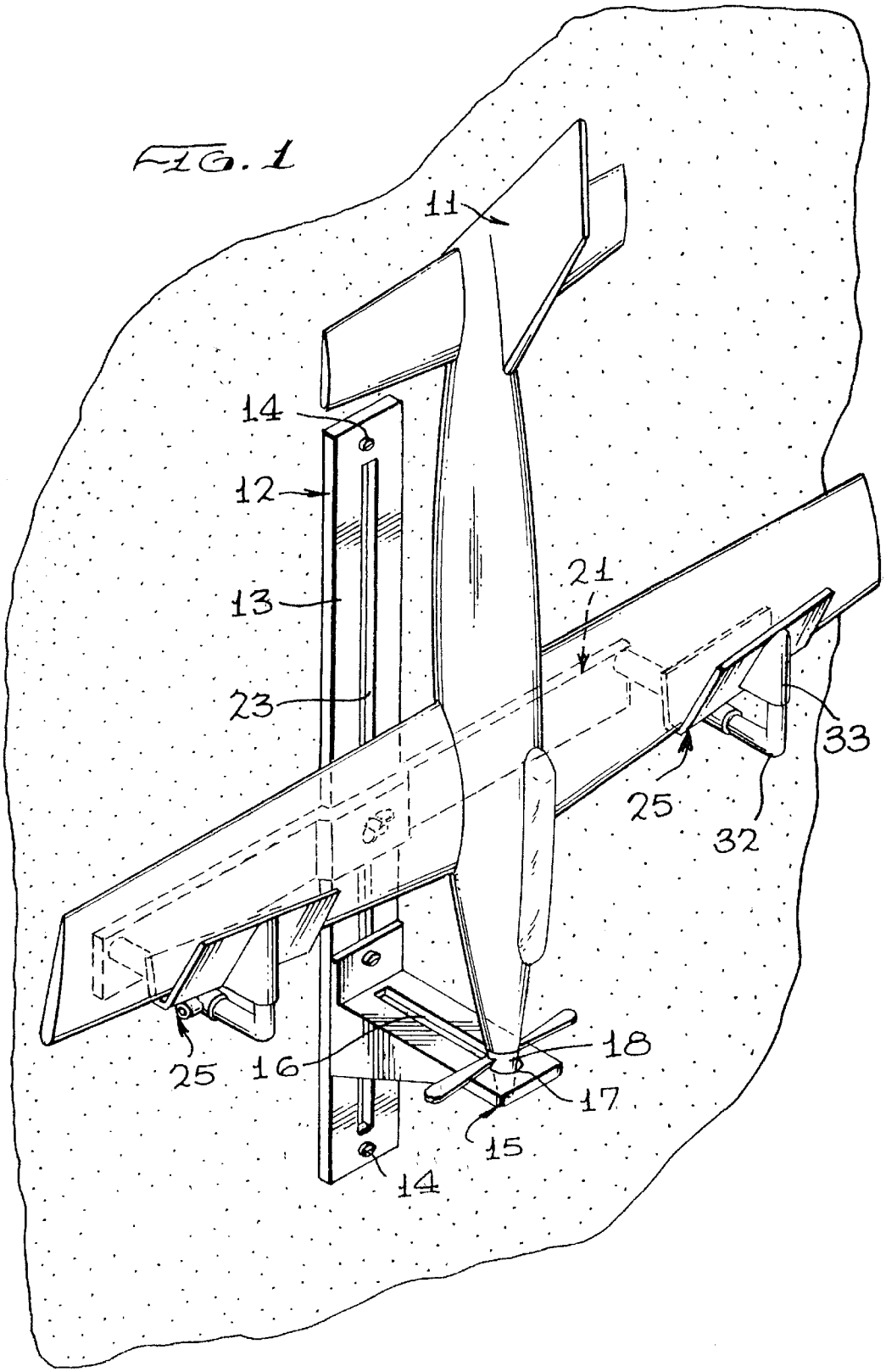
FIG. 1 is a frontal perspective view of a preferred embodiment of the subject invention, with a typical model airplane mounted to it for storage and display.

FIG. 1 illustrates a typical model airplane 11 mounted for storage and display on a bracket 12 constructed in accordance with the subject invention. As seen more clearly in FIG. 2, bracket 12 includes a vertical member 13 adapted for attachment to a wall or other structure by convenient means, such as screws 14. A tongue 15 formed at the lower end of vertical member 13 extends outwardly, that is, away from the wall or mounting surface to support the nose of the model airplane 11. Preferably, the components of mounting bracket 12 are molded of one of the many well known suitable durable, rigid or resilient thermoplastic materials. Alternatively, some, or all of the components may be formed of sheet metal, wood, composite, or other materials, or combinations of such materials.

Alternative conventional retaining means, such as slot 16 and generally conical opening 17, are provided on tongue 15 to retain the nose of virtually any model airplane 11. If it is desired to support the entire weight of the model on the engine mount, for example, in larger, heavier models incorporating an especially sturdy engine-mounting structure, the slot 16 allows the propeller to be removed and the engine drive shaft secured firmly to the tongue 15 by means of a back-up nut (not shown). For models having tapered propeller spinners 18 and not requiring such rigid support, the conical opening 17 provides a convenient receptacle for the spinner 18, allowing the tongue 15 to support the model on its nose without danger of the nose slipping.

A horizontal member 21 is slidably mounted to vertical member 13 by conventional retaining means, such as bolt 22 passing through horizontal member 21 and slot 23 in vertical member 13, and wing nut 24, which allow horizontal member 21 to be raised or lowered at will and readily secured to vertical member 13 at any desired height above tongue 15.

One, or preferably a pair of, generally U- or V-shaped wing retaining holders 25 are mounted to the horizontal member 21 by means of arms 26 secured to and extending outwardly of member 21. The specific design of holders 25 is not part of the present invention, it being understood that they are configured and sized to receive the wings of the model for which the mounting bracket is to be used, and to maintain, or assist in maintaining, the fuselage in an upright position on tongue 15.

The horizontal portion of arm 26 includes a shaft 27 slidably inserted into a sleeve 28. If desired, sleeve 28 may be provided with a set screw 31 for retaining shaft 27 once it has been positioned to conform to the model airplane being stored or displayed. An elbow in shaft 27 effectively allows a portion of shaft 27 to serve as a riser 32. Riser 32 slips into a sleeve 33 formed on holder 25. This arrangement allows the spacing of holders 25 from horizontal member 21 (and thus, from the adjacent wall, when the bracket is mounted to a wall) to be adjusted to compensate for the size and configuration of virtually any model airplane, and permits holders 25 to rotate about the axis of sleeve 28 and pivot about the axis of riser 32. to conform with the sweep and dihedral of any wing.

It will be understood that any number of well known additional or alternative mounting methods and means can be employed to serve the same purpose, that is, to leave the holders 25 free to orient themselves to conform with the sweep of the leading edges of any model's wings and with the wings' dihedral, and to allow the spacing of holders 25 from vertical member 13 to be adjusted for models of varying size and configuration. By way of one example, to increase the range of sizes and configurations of models the mounting bracket of the invention can support, tongue 15 can be constructed or provided with extensible means enabling the user to increase the spacing of the nose retaining means, opening 16 and slot 17, from vertical member 13, thereby allowing the bracket to store and display the largest of models. Likewise, while the general size and shape of holders 25 as illustrated are suitable for receiving almost any model airplane wings and maintaining the model upright on tongue 15 as shown in FIG. 1, the invention is not intended to be restricted to the sizes, shapes, or construction described here. The invention is intended to encompass any and all functionally equivalent wing receiving and retaining methods and means, not merely those illustrated and described here.

In operating the embodiment of FIGS. 1 and 2, the spacing of holders 25 from horizontal member 21 is adjusted to suit the size and configuration of the model 11 and, if desired (but not necessarily) fixed by means of set screw 31. Holders 25 are spaced vertically above tongue 15 by adjusting horizontal member 21 on vertical member 13 and securing it in place by means of wing nut 24. Holders 25 can be positioned to allow the full weight of the model to be supported by tongue 15, or, with care, to allow holders 25 to bear some portion of the weight. The alternative embodiments of the invention illustrated in FIGS. 3 and 4 are adapted to distribute the model's weight between the wings and the fuselage without need for such careful adjustment.

In the embodiment of FIG. 3, holders 25 are supported on riser 32 through a compression spring 34 contained within sleeve 33. By adjusting the vertical position of horizontal member 21 to position holders 25 roughly within the compression range of spring 34, the holders 25 can be adapted to support any desired proportionate part of the model's weight.

The embodiment of FIG. 4 achieves the same result by mounting the holders 25 resiliently to vertical member 13 directly, rather than through horizontal member 21. Here, the horizontal member 21 is formed in two parts. The adjustable lower member 35 is mounted directly to vertical member 13 and carries the locking device, wing nut 24. The second part, upper member 36, is mounted directly to lower member 35 by resilient means, such as pistons 37 supported by compression springs 38. As with the embodiment of FIG. 3, holders 25 are effectively supported resiliently on vertical member 13, and by appropriate positioning of adjustable member 35 can be made to share the load of the model with tongue 15. Once again, the particular construction shown is not intended to be the only method or means for resiliently supporting the upper part of horizontal member 21.

From the foregoing description, the function and purpose of the invention and the advantages afforded by its novel features will be readily apparent to one skilled in the art. As pointed out previously, it should be understood, that although the invention has been described in terms of the specific constructions and materials shown in the drawings and mentioned in the specification, it is not to be construed as limited to those embodiments. They are to be regarded as illustrative rather than restrictive. This specification is intended to encompass any and all variations and equivalents of the examples chosen for purposes of the disclosure, which do not depart from the spirit and scope of the following claims.

What is claimed is:

1. A wall-mounted bracket for model airplanes, comprising:

a vertical member adapted for mounting to a wall and having an outwardly extending tongue at its lower end for retaining and supporting a model airplane on its nose;

a horizontal member adjustably mounted to said vertical member; and a wing-retaining holder mounted to said horizontal member and vertically resiliently mounted to said vertical member, said holder restricting the movement of the model and maintaining it upright on the tongue.

2. A wall-mounted bracket for model airplanes, comprising:

a vertical member adapted for mounting to a wall and having an outwardly extending tongue at its lower end retaining and supporting a model airplane on its nose;

a horizontal member adjustably mounted to said vertical member; and a pair of spaced wing-retaining holders vertically resiliently mounted to said horizontal member, said holders restricting the movement of the model, maintaining it upright, and bearing a portion of the weight of the model.

3. A wall-mounted bracket for model airplanes in accordance with claim 2, wherein said wing-retaining holders are rotatably mounted to said horizontal member.

4. A wail-mounted bracket for model airplanes in accordance with claim 2, wherein said wing-retaining holders are pivotably mounted to said horizontal member.

5. A wall-mounted bracket for model airplanes in accordance with claim 2, wherein said wing-retaining holders are adjustably spaced from said horizontal member.

6. A wall-mounted bracket for model airplanes in accordance with claim 1, wherein said horizontal member is vertically resiliently mounted to said vertical member.

7. A wall-mounted bracket for model airplanes in accordance with claim 6, wherein said wing-retaining holder is rotatably mounted to said horizontal member.

8. A wall-mounted bracket for model airplanes in accordance with claim 6, wherein said wing-retaining holder is pivotably mounted to said horizontal member.

9. A wall-mounted bracket for model airplanes in accordance with claim 6, wherein said wing-retaining holder is adjustably spaced from said horizontal member.

10. A method for mounting a model airplane to a wall for storage and display, comprising:

providing a vertical member adapted for mounting to a wall and having an outwardly extending tongue at its lower end retaining and supporting a model airplane on its nose;

providing a horizontal member adjustably mounted to said vertical member;

providing a pair of spaced wing-retaining holders vertically resiliently mounted to said horizontal member, said holders restricting the movement of the model, maintaining it upright, and bearing a portion of the weight of the model;

adjusting the horizontal member to position the wing-retaining holders in conformity with the wings of the model;

inserting the wings of the model into the wing-retaining holders; and positioning the nose of the model in supporting, retaining engagement with the tongue.

* * * * *